US010516211B2

(12) United States Patent
Reitner

(10) Patent No.: US 10,516,211 B2
(45) Date of Patent: Dec. 24, 2019

(54) DUAL BAND ANTENNA

(71) Applicant: BSH HAUSGERAETE GMBH, Munich (DE)

(72) Inventor: Josef Reitner, Donaustauf (DE)

(73) Assignee: BSH Hausgeraete GmbH, Munich (DE)

( * ) Notice: Subject to any disclaimer, the term of this patent is extended or adjusted under 35 U.S.C. 154(b) by 54 days.

(21) Appl. No.: 15/746,443

(22) PCT Filed: Aug. 4, 2016

(86) PCT No.: PCT/EP2016/068653
§ 371 (c)(1),
(2) Date: Jan. 22, 2018

(87) PCT Pub. No.: WO2017/032578
PCT Pub. Date: Mar. 2, 2017

(65) Prior Publication Data

US 2018/0205150 A1 Jul. 19, 2018

(30) Foreign Application Priority Data

Aug. 21, 2015 (DE) ..... 10 2015 215 987

(51) Int. Cl.

| | |
|---|---|
| ***H01Q 1/22*** | (2006.01) |
| ***H01Q 9/44*** | (2006.01) |
| ***H01Q 1/48*** | (2006.01) |
| ***H01Q 5/371*** | (2015.01) |
| ***H01Q 9/40*** | (2006.01) |
| ***H01Q 9/42*** | (2006.01) |

(52) U.S. Cl.
CPC ..... *H01Q 5/371* (2015.01); *H01Q 1/22* (2013.01); *H01Q 1/2291* (2013.01); *H01Q 1/48* (2013.01); *H01Q 9/40* (2013.01); *H01Q 9/42* (2013.01); *H01Q 9/44* (2013.01)

(58) Field of Classification Search
CPC ..... H01Q 5/371; H01Q 1/2291; H01Q 9/44; H01Q 1/22; H01Q 9/40; H01Q 1/48; H01Q 9/42
USPC ..... 343/808
See application file for complete search history.

(56) References Cited

U.S. PATENT DOCUMENTS

2005/0156783 A1* 7/2005 Lu ..... H01Q 1/243 343/700 MS
2008/0024369 A1* 1/2008 Shinkai ..... H01Q 1/22 343/700 MS
2010/0321274 A1 12/2010 Wu
(Continued)

FOREIGN PATENT DOCUMENTS

EP 1367671 A2 12/2003
JP 2004140496 A 5/2004

*Primary Examiner* — Hai V Tran
(74) *Attorney, Agent, or Firm* — Laurence A. Greenberg; Werner H. Stemer; Ralph E. Locher

(57) ABSTRACT

A dual band antenna for a first frequency range and a second frequency range includes a first radiator for the first frequency range as well as a second radiator for the second frequency range. The dual band antenna also includes a ground conductor as an antipole to the first and second radiators. The first radiator and the second radiator join in a V shape at a base of the dual band antenna. A domestic appliance including a communication unit which has a dual band antenna is also provided.

13 Claims, 1 Drawing Sheet

(56) References Cited

U.S. PATENT DOCUMENTS

2015/0282666 A1* 10/2015 Gerl ..... F24C 7/082
700/90

* cited by examiner

DUAL BAND ANTENNA

BACKGROUND OF THE INVENTION

Field of the Invention

The invention relates to a dual band antenna for sending and/or receiving radio signals.

An electronic appliance which is configured to communicate via a wireless communication network typically comprises at least one antenna for receiving and/or transmitting radio signals. In this case, the electronic appliance may be configured to receive and/or send radio signals via a multiplicity of different frequency bands, in particular via two different frequency bands or frequency ranges. The appliance may have a multiband antenna for this purpose, in particular a dual band antenna.

Dual band antennas often comprise secondary radiators (in the form of ferrite rods or slot radiators) in order to achieve a predefined frequency characteristic and bandwidth for two different frequency bands. This applies in particular to dual band antennas for the frequency bands 2.4-2.5 GHz and 5.1-5.8 GHz, i.e. to WLAN (Wireless Local Area Network) dual band antennas. The use of secondary antennas results in a directional emission of radio signals, and consequently to a directionally dependent radio capability of an electronic appliance.

Domestic appliances, in particular household appliances such as e.g. ovens, refrigerators, washing machines, dishwashers, etc., increasingly feature communication units for wireless communication (in particular via a WLAN). Domestic appliances are installed at different locations in the household in this case. Therefore the dual band antennas used for domestic appliances should have optimum omnidirectional functionality in order to ensure a communication capability which is as constant as possible at all possible installation locations. Directivity resulting from secondary radiators in a dual band antenna is therefore disadvantageous for use in domestic appliances in particular.

SUMMARY OF THE INVENTION

The technical object of the present document is to provide a dual band antenna which can be integrated on a printed circuit board of an electronic component of an appliance, and which has an omnidirectional functionality that is as uniform as possible.

The object is achieved by the independent claims. Advantageous embodiment variants are described inter alia in the dependent claims.

According to a first aspect, a dual band antenna for a first and a second frequency range is described. The dual band antenna comprises a first radiator for the first frequency range and a second radiator for the second frequency range. The dual band antenna further comprises a ground conductor (or earth conductor) as an antipole to the first and second radiators. The first radiator and the second radiator join in a V shape at a base of the dual band antenna.

According to a further aspect, a domestic appliance, in particular a household appliance, comprising a communication unit for wireless communication (in particular via a WLAN) is described, said communication unit featuring the dual band antenna described in this document.

It should be noted that the devices and systems described in this document can be used both alone and in combination with other devices and systems described in this document. Furthermore, any aspects of the devices and systems described in this document can be combined with each other in many and diverse ways. In particular, the features in the claims can be combined with each other in many and diverse ways.

BRIEF DESCRIPTION OF THE SEVERAL VIEWS OF THE DRAWING

The invention is described in greater detail below with reference to exemplary embodiments, wherein.

DESCRIPTION OF THE INVENTION

As stated in the introduction, the present document is concerned with the provision of a dual band antenna which can be integrated and has uniform omnidirectional functionality. In this case, the dual band antenna is intended in particular for WLAN radio communication in the 2.4 GHz and 5 GHz frequency bands.

Figure 1:
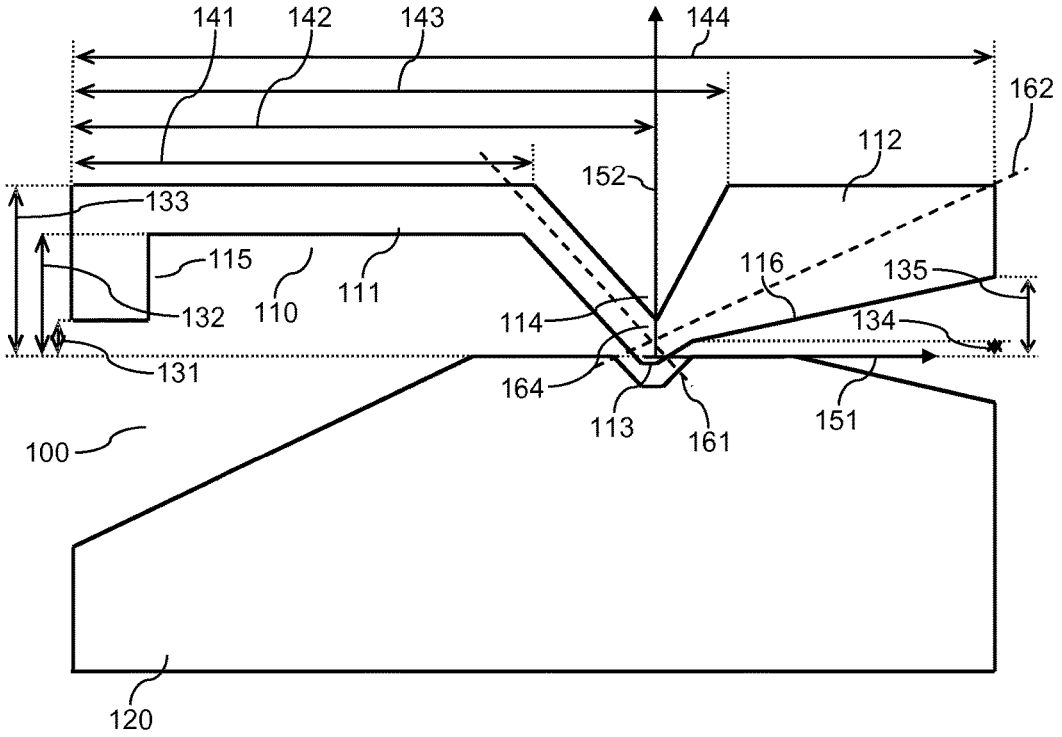
FIG. 1 shows the structure and dimensioning of an exemplary dual band antenna.
Figure 2:
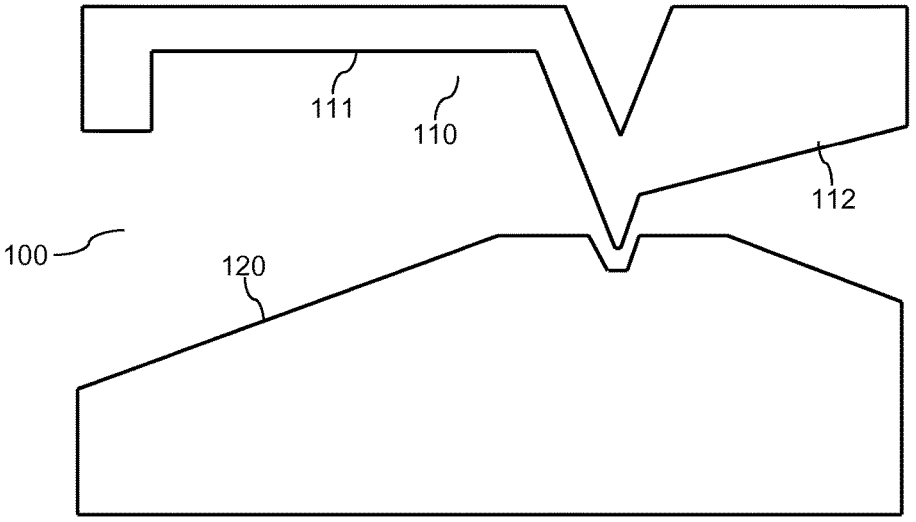
FIG. 2 shows a further view of the exemplary dual band antenna from FIG. 1, from which the relative dimensions of the dual band antenna are evident.

FIGS. 1 and 2 show the structure of an exemplary dual band antenna 100 which satisfies the conditions cited above. The dual band antenna comprises a ground plane 120 (ground conductor or earth conductor) and a dual band radiator 110. The dual band radiator 110 comprises a first radiator 111 for a first frequency band (in particular the 2.4 GHz frequency band) and a second radiator 112 for a second frequency band (in particular the 5 GHz frequency band). The first and second radiators 111, 112 each have specific geometries, which are adapted to the properties (in particular the bandwidth) of the respective frequency band (or frequency range). Furthermore, the radiators 111, 112 are arranged such that mutual interference is reduced (i.e. minimized where possible). The supply of the radio signals to be sent takes place via a shared feed-in point or base 113.

The antenna geometry illustrated in FIGS. 1 and 2 can be integrated into the conductive layer of a printed circuit board. In particular, the radiators 111, 112 and the ground plane 120 can be implemented as flat conductors in a conductive layer of a printed circuit board. This makes it possible to provide an economical dual band antenna 100. In particular, the geometry of a dual band antenna 100 as illustrated in FIGS. 1 and 2 allows the active area of the antenna to be optimally configured on a printed circuit board. The antenna geometry does not include any secondary radiators in this case, in order to obtain optimum omnidirectional characteristics.

The first radiator 111 and the second radiator 112 each comprise $\lambda/4$ radiators for the first and the second frequency range respectively (i.e. for the respective corresponding wavelength range). The respective $\lambda/4$ radiators start at the base 113 and extend over the whole (possibly crooked) length of the respective radiator 111, 112.

Furthermore, the radiators 111, 112 have a width which is dependent on the bandwidth of the respective frequency range. In this case, the width of a radiator 111, 112 typically increases with increasing bandwidth of the frequency range. In the case of the dual band antenna 100 illustrated in FIGS. 1 and 2, the first radiator 111 covers the first frequency range 2.4-2.5 GHz (i.e. the 2.4 GHz WLAN frequency band) and the second radiator 112 covers the second frequency range 5.1-5.8 GHz (i.e. the 5 GHz WLAN frequency band). In order to cover the higher bandwidth of the second frequency range, the width of the second radiator 112 is greater than that of the first radiator 111. Furthermore, the oblique course of the lower or inner edge 116 of the second radiator has a positive effect on the provision of a relatively high bandwidth.

As stated above, the dual band antenna 100 in FIGS. 1 and 2 has no secondary radiators. Instead, the first radiator 111 and the second radiator 112 are as far as possible decoupled by virtue of the radiators 111, 112 extending away from the base 113 at an angle. In this case, the first radiator 111 and the second radiator 112 can form an angle 114 at the base, said angle being 45° or thereabout. Good decoupling of the radiators 111, 112 can be achieved thereby.

In particular, good decoupling can be achieved if an effective extension of the first radiator 111 starting from the base 113 (illustrated by a first artificial line 161) and an effective extension of the second radiator 112 starting from the base 113 (illustrated by a second artificial line 162) are approximately perpendicular to each other (e.g. forming an angle 164 in the range 80° to 100°).

The first radiator 111 has a greater length than the second radiator 112, owing to the lower first frequency range. An end region 115 of the first radiator 111 is crooked in this case, in order to position the first radiator 111 on the available space of a printed circuit board.

FIG. 1 shows exemplary dimensions of the dual band radiator from FIGS. 1 and 2. In this case, the distance 131 is 3.4 mm, the distance 132 is 5.8 mm, the distance 133 is 7.2 mm, the distance 134 is 1.4 mm, the distance 135 is 3.5 mm, the distance 141 is 15 mm, the distance 142 is 17 mm, the distance 143 is 18.8 mm and the distance 144 is 26 mm. The cited values may vary by 15% upwards and/or downwards in this case. FIG. 2 shows the components 111, 112, 120 of the dual band antenna 100 in magnified form but with the correct relative dimensions.

The present document therefore describes a dual band antenna 100 for a first and a second frequency range (i.e. for a first and a second frequency band). In this case, the two frequency ranges do not typically overlap. The first frequency range preferably comprises the frequencies 2.4-2.5 GHz and the second frequency range preferably comprises the frequencies 5.1-5.8 GHz.

The dual band antenna 100 comprises a first radiator 111 for the first frequency range and a second radiator 112 for the second frequency range. Furthermore, the dual band antenna 100 comprises a ground conductor 120 as an antipole to the first and second radiators 111, 112. In this case, the first radiator 111 and the second radiator 112 join in a V shape at a base 113 of the dual band antenna 100. By virtue of such V-shaped joining, it is possible to effect a substantial decoupling of the radiators 111, 112 (without using secondary antennas). A dual band antenna 100 with good omnidirectional functionality can therefore be provided.

In particular, the first radiator 111 and the second radiator 112 can join in a V shape such that the radiators 111, 112 form an angle 114 of between 40° and 50° at the base 113, in particular an angle of 45°. By virtue of such a V-shaped arrangement, it is possible to achieve particularly good decoupling of the two radiators 111, 112.

The dual band antenna 100 is typically configured to deliver at the base 113 a radio signal which has been received and is in the first and/or the second frequency range, and/or to accept at the base 113 a radio signal which is to be sent and is in the first and/or the second frequency range.

The first radiator 111 and the second radiator 112 preferably take the form of λ/4 radiators for a frequency from the respective frequency range. For this purpose, the radiators 111, 112 typically have an effective length (starting from the base 113) which corresponds to a quarter of the wavelength of a signal which is to be sent or received. For example, a λ/4 radiator for 2.5 GHz has an effective length of approximately 30 mm and a λ/4 radiator for 5.4 GHz has an effective length of approximately 12 mm.

The first radiator 111, the second radiator 112 and the ground conductor 120 are preferably arranged in a such a way that, for an x-axis 151 of a Cartesian system of coordinates which runs through the base 113, the first and second radiators 111, 112 lie on a first side (the upper side in FIGS. 1 and 2) and the ground conductor 120 on a second side (the lower side in FIGS. 1 and 2) of the x-axis 151. In other words, the dual band antenna 100 can be divided into two halves by the x-axis 151, such that the first radiator 111 and the second radiator 112 are situated on one side and the ground conductor 120 on the other side of the x-axis 151 (at least respectively 90%, 95% or more of the surface of the radiators 111, 112 and ground conductor 120).

Furthermore, the first radiator 111, the second radiator 112 and the ground conductor 120 are preferably arranged in such a way that, for a y-axis 152 of the Cartesian system of coordinates running through the base, the first radiator 111 lies on a first side (the left-hand side in FIGS. 1 and 2) and the second radiator 112 lies on a second side (the right-hand side in FIGS. 1 and 2) of the y-axis 152. In other words, the dual band radiator 110 can be divided into two halves by the y-axis 152, such that the first radiator 111 is situated on one side and the second radiator 112 on the other side of the y-axis 152 (at least respectively 90%, 95% or more of the surface of the radiators 111, 112). Such an arrangement allows good decoupling of the radiators 111, 112 from each other.

The first radiator 111 and the second radiator 112 can each comprise a decoupling segment, which begins at the base 113 and extends obliquely away from the y-axis 152 starting from the base 113, such that the decoupling segments of the first and second radiators 111, 112 join in a V shape at the base 113. For the frequency ranges cited above, the decoupling segments can have an extension along the y-axis 152 of 7.2 mm starting from the base 113.

Furthermore, the decoupling segment of the first radiator 111 can have an extension along the x-axis 151 of 2 mm starting from the base 113. On the other side, the decoupling segment of the second radiator 112 can have an extension along the x-axis 151 of 1.8 mm starting from the base 113. The cited values may vary by 15% upwards and/or downwards in this case.

The first radiator 111 can further comprise a straight antenna segment which extends parallel to the x-axis 151 and away from the y-axis 152. For the above cited first frequency range, starting from the decoupling segment of the first radiator 111, the straight antenna segment can have an extension along the x-axis 151 of 15 mm and possibly a width along the y-axis 152 of 1.4 mm in this case. The cited values may vary by 15% upwards and/or downwards in this case.

Furthermore, the first radiator 111 can comprise a crooked antenna segment which extends parallel to the y-axis 152 and towards the x-axis 151. By using a crooked antenna segment, it is possible to reduce the space requirement of the dual band antenna 100. For the above cited first frequency range, the crooked antenna segment can have an extension along the y-axis 152 of 2.4 mm starting from an edge of the straight antenna segment which faces towards the ground conductor 120, and an extension along the y-axis 152 of 3.8 mm starting from an edge of the straight antenna segment which faces away from the ground conductor 120. The cited values may vary by 15% upwards and/or downwards in this case.

As shown in FIGS. 1 and 2, the first radiator 111 can have in particular a decoupling segment, a straight antenna segment and an angled antenna segment, these being consecutively disposed in the cited order starting from the base 113. At the transition zones between the respective segments, bends and/or corners are produced in each case as a result of the different orientations of the segments. In this case, the above cited dimensions of the respective segments produce a λ/4 radiator for the first frequency range around 2.4 GHz.

The first radiator 111 can comprise a multiplicity of segments. In this case, one or more segments of the first radiator 111 can have a bar-shaped elongation, wherein the edges of the one or more segments always run parallel to each other. By virtue of the parallel course of the edges, the first frequency range can be adjusted in a precise manner.

The second radiator 112 can have a trapezoidal antenna segment with an inner edge 116 which delimits the trapezoidal segment on a side that faces towards the ground conductor 120. The inner edge 116 runs obliquely away from the x-axis 151 as the distance from the base 113 increases. By means of such an oblique course, the bandwidth of the second radiator 112 can be increased.

For the above cited second frequency range, starting from the decoupling segment of the second radiator 112, the trapezoidal antenna segment can have an extension along the x-axis 151 of 7.2 mm. Furthermore, the trapezoidal antenna segment can have a width of 5.8 mm on a side which faces the decoupling segment of the second radiator 112, and a width of 3.7 mm on a side which faces away from the decoupling segment of the second radiator 112. The cited values may vary by 15% upwards and/or downwards in this case.

As illustrated in FIGS. 1 and 2, the second radiator 112 can have a decoupling segment and a trapezoidal antenna segment, these being consecutively disposed in the cited order starting from the base 113. In this case, the above cited dimensions of the respective segments produce a λ/4 radiator for the second frequency range at 5 GHz.

The second frequency range can have a greater bandwidth than the first frequency range. For this purpose, the second radiator 112 can be wider than the first radiator 111 relative to a longitudinal direction corresponding to the x-axis 151.

Two artificial lines 161, 162 are illustrated in FIG. 1 for the first radiator 111 and the second radiator 112. The artificial lines 161, 162 each run longitudinally through the middle of the respective radiator 111, 112 or a segment of the radiator 111, 112. In particular, the first artificial line 161 runs longitudinally through the middle of the decoupling segment of the first radiator 111. The second artificial line 162 runs longitudinally through the middle of the whole second radiator 112. The two artificial lines 161, 162 intersect in the vicinity of the base 113 and form an angle 164. This angle 164 preferably lies in the range from 80° to 100°, in particular 85° or 90°, in order to effect an optimal decoupling of the radiators 111, 112.

In other words, a first artificial line 161 running longitudinally through the middle of the decoupling segment of the first radiator 111 towards the base 113 and a second artificial line 162 running longitudinally through the middle of the second radiator 112 towards the base 113 form an angle 164 at a point of intersection. This angle 164 can have a value of 80°-100° at the point of intersection in order to effect an optimal decoupling of the radiators 111, 112.

The first radiator 111, the second radiator 112 and the ground conductor 120 can each comprise conductor surfaces of a printed circuit board. In other words, the components of the dual band antenna 100 can be implemented as conductor surfaces of a printed circuit board. A cost-efficient dual band antenna 100 can be provided thus. If applicable, a multiplicity of dual band antennas 100 (e.g. two dual band antennas 100) can be implemented in a printed circuit board. Antenna diversity can thus be provided in an efficient manner.

The present document further describes a domestic appliance, in particular a household appliance, which comprises a communication unit for wireless communication, said communication unit featuring the dual band antenna 100 described in this document.

The FIGS. 1 and 2 shows a dual band antenna 100, in which two different frequency bands are covered by the use of primary radiators 111, 112 exclusively. As a result of dispensing with secondary radiators, the dual band antenna 100 has good omnidirectional functionality. Furthermore, the dual band antenna 100 can be implemented on a printed circuit board in a cost-efficient manner.

The present invention is not restricted to the exemplary embodiments shown. In particular, it should be noted that the description and the figures are only intended to illustrate the principle of the proposed devices and systems.

The invention claimed is:

1. A dual band antenna for a first frequency range and a second frequency range, the dual band antenna comprising:

a first radiator for the first frequency range, said first radiator having a decoupling segment, a straight antenna segment following said decoupling segment and an angled antenna segment following said straight antenna segment starting from a base of the dual band antenna;

a second radiator for the second frequency range, said second radiator having a decoupling segment and a trapezoidal antenna segment following said decoupling segment starting from said base;

said first radiator and said second radiator joining in a V shape at said base;

a ground conductor as an antipole to said first and second radiators;

said first radiator, said second radiator and said ground conductor being disposed along:

an x-axis of a Cartesian system of coordinates running through said base, said first and second radiators lying on a first side and said ground conductor lying on a second side of the x-axis and a y-axis of the Cartesian system of coordinates running through said base, said first radiator lying on a first side and said second radiator lying on a second side of the y-axis; and with an accuracy of plus or minus 15%;

said decoupling segments having an extension along the y-axis of 7.2 mm starting from said base;

said decoupling segment of said first radiator having an extension along the x-axis of 2 mm starting from said base;

said decoupling segment of said second radiator having an extension along the x-axis of 1.8 mm starting from said base;

said straight antenna segment having an extension along the x-axis of 15 mm and a width along the y-axis of 1.4 mm starting from said decoupling segment of said first radiator;

said trapezoidal antenna segment having an extension along the x-axis of 7.2 mm starting from said decoupling segment of said second radiator;

said angled antenna segment having extension along the y-axis of 2.4 mm starting from an edge facing towards said ground conductor, and an extension along the y-axis of 3.8 mm starting from an edge facing away from said ground conductor; and said trapezoidal antenna segment having a width of 5.8 mm on a side facing towards said decoupling segment of said second radiator, and a width of 3.7 mm on a side facing away from said decoupling segment of said second radiator.

2. The dual band antenna according to claim 1, wherein said first radiator and said second radiator form an angle of between 40° and 50° at said base.

3. The dual band antenna according to claim 1, wherein said first radiator and said second radiator form an angle of 45° at said base.

4. The dual band antenna according to claim 1, wherein said first radiator and said second radiator each include a decoupling segment:

beginning at said base; and starting from said base extending obliquely away from the y-axis, causing said decoupling segments of said first and of said second radiators to join in a V shape at said base.

5. The dual band antenna according to claim 1, wherein said first radiator includes a straight antenna segment extending parallel to the x-axis and away from the y-axis.

6. The dual band antenna according to claim 1, wherein said first radiator includes an angled antenna segment extending parallel to the y-axis and towards the x-axis.

7. The dual band antenna according to claim 1, wherein:

said second radiator has a trapezoidal antenna segment with an inner edge delimiting said trapezoidal segment on a side facing towards said ground conductor; and said inner edge runs obliquely away from the x-axis as a distance from said base increases.

8. The dual band antenna according to claim 1, wherein:

the second frequency range has a greater bandwidth than the first frequency range; and said second radiator is wider than said first radiator in a longitudinal direction corresponding to the x-axis.

9. The dual band antenna according to claim 1, which further comprises:

a first artificial line running longitudinally through a middle of said decoupling segment of said first radiator towards said base; and a second artificial line running longitudinally through a middle of said second radiator towards said base;

said first and second artificial lines forming an angle therebetween at a point of intersection having a value of 80°-100°.

10. The dual band antenna according to claim 1, wherein said first radiator, said second radiator and said ground conductor each include conductor surfaces of a printed circuit board.

11. The dual band antenna according to claim 1, wherein:

the first frequency range includes frequencies of 2.4-2.5 GHz; and the second frequency range includes frequencies of 5.1-5.8 GHz.

12. The dual band antenna according to claim 1, wherein the dual band antenna is configured to at least one of:

deliver at said base a radio signal having been received and being in at least one of the first or second frequency ranges, or accept at said base a radio signal to be sent and being in at least one of the first or second frequency ranges.

13. A domestic appliance, comprising:

a communication unit having a dual band antenna according to claim 1.

* * * * *